United States Patent [19]

Atago

[11] Patent Number: 4,590,912

[45] Date of Patent: May 27, 1986

[54] AIR-FUEL RATIO CONTROL APPARATUS FOR INTERNAL COMBUSTION ENGINES

[75] Inventor: Takeshi Atago, Katsuta, Japan

[73] Assignee: Hitachi, Ltd., Tokyo, Japan

[21] Appl. No.: 672,367

[22] Filed: Nov. 16, 1984

[30] Foreign Application Priority Data

Nov. 21, 1983 [JP] Japan ..... 58-219169
Nov. 28, 1983 [JP] Japan ..... 58-222245

[51] Int. Cl.[4] ..... F02M 7/04
[52] U.S. Cl. ..... 123/478; 123/480; 123/492
[58] Field of Search ..... 123/478, 480, 492, 493, 123/438, 422

[56] References Cited

U.S. PATENT DOCUMENTS

| | | | |
|---|---|---|---|
| 4,335,694 | 6/1982 | Mausner et al. | 123/478 |
| 4,335,695 | 6/1982 | Phipps | 123/478 |
| 4,398,515 | 8/1983 | Canup et al. | 123/478 |
| 4,418,673 | 12/1983 | Tominari et al. | 123/478 |
| 4,470,396 | 9/1984 | Hasumi et al. | 123/478 |
| 4,487,186 | 12/1984 | Wahl et al. | 123/478 |

*Primary Examiner*—Raymond A. Nelli
*Attorney, Agent, or Firm*—Antonelli, Terry & Wands

[57] ABSTRACT

An air-fuel ratio control apparatus for an internal combustion engine accurately controls the air-fuel ratio of a mixture by first determining the desired fuel injection quantity in accordance with the engine speed and the amount of depression of the accelerator pedal, then determining the desired amount of intake air flow and finally controlling the opening of the throttle valve in accordance with the desired amount of intake air flow.

4 Claims, 19 Drawing Figures

AIR-FUEL RATIO CONTROL APPARATUS FOR INTERNAL COMBUSTION ENGINES

The present invention relates to a control apparatus for internal combustion engines, such as, automobile gasoline engines, and more particularly it relates to an engine control apparatus employing a preferential fuel quantity control method to make an accurate air-fuel ratio control.

In the operation of an internal combustion engine such as a gasoline engine, it is desirable that the air-fuel ratio (hereinafter simply referred to as an A/F) or the ratio between the air and fuel in an inducted mixture is accurately maintained at the desired value.

Control methods have heretofore been used with automobile gasoline engines in which the amount of intake air flow is controlled through the operation of the throttle valve mechanically coupled to the accelerator pedal and the fuel quantity corresponding to the amount of air flow is determined mechanically in the case of engines equipped with a carburetor and electrically in the case of engines equipped with an electronically controlled fuel injection system thereby obtaining the desired A/F.

However, there is a great difference in specific gravity between the air and the fuel such as gasoline so that during the transitional operation the amount of intake air flow varies rapidly as compared with the fuel quantity due to the difference in inertia between the two caused by the feeding operation. Thus, there is a disadvantage that these known methods cannot ensure a satisfactory A/F control under the transient conditions with the result that as for example, the A/F becomes lean first for a short period of time during the acceleration period and the A/F becomes rich first for a short period of time during the deceleration period thus failing to always maintain the A/F at the proper value.

Thus, with a view to overcoming the foregoing deficiencies of the above-mentioned conventional methods employing the conventional mixture feed system of a so-called preferential control method in which the amount of intake air flow is controlled preferentially, that is, the fuel quantity is controlled to follow up the intake air flow, mixture feed systems of a preferential control method controlling the fuel quantity preferentially or controlling the amount of intake air flow to follow up the fuel quantity have been proposed for example in Japanese Laid-Open Patent Applicatrons No. 53-40131 and No. 57-91345. However, these known systems have been insufficient from the standpoints of control accuracy and response characteristic.

The present invention has been made in view of these circumferences and it is an object of the invention to provide an air-fuel ratio control apparatus for internal combustion engines which is improved in control accuracy and response characteristic over the known mixture feed systems employing the preferential fuel quantity control or follow-up air flow control method and which always ensures excellent A/F control and improved drivability (driving comfort) during the transitional engine operating conditions.

To accomplish these objects, the invention has a feature that in accordance with control commands to the engine and the then current operating conditions of the engine the optimum control data is preliminarily prepared and stored in a memory and the control data is used to control engine controlling actuator means.

Another feature of the invention comprises computing first a fuel injection quantity corresponding to the operating conditions of the engine by first computing means, computing the optimum amount of intake air flow corresponding to the previously computed fuel injection quantity by second computing means and variably controlling the opening of the throttle valve in the intake air passage without direct connection to the accelerator pedal so as to make the actual amount of intake air flow coincide with the computed amount of intake air flow.

The invention will become more apparent from the following detailed description taken in conjunction with the accompanying drawings, in which.

The air-fuel ratio control apparatus for engines according to the invention will now be described in greater detail with reference to the illustrated embodiments.

Figure 1:
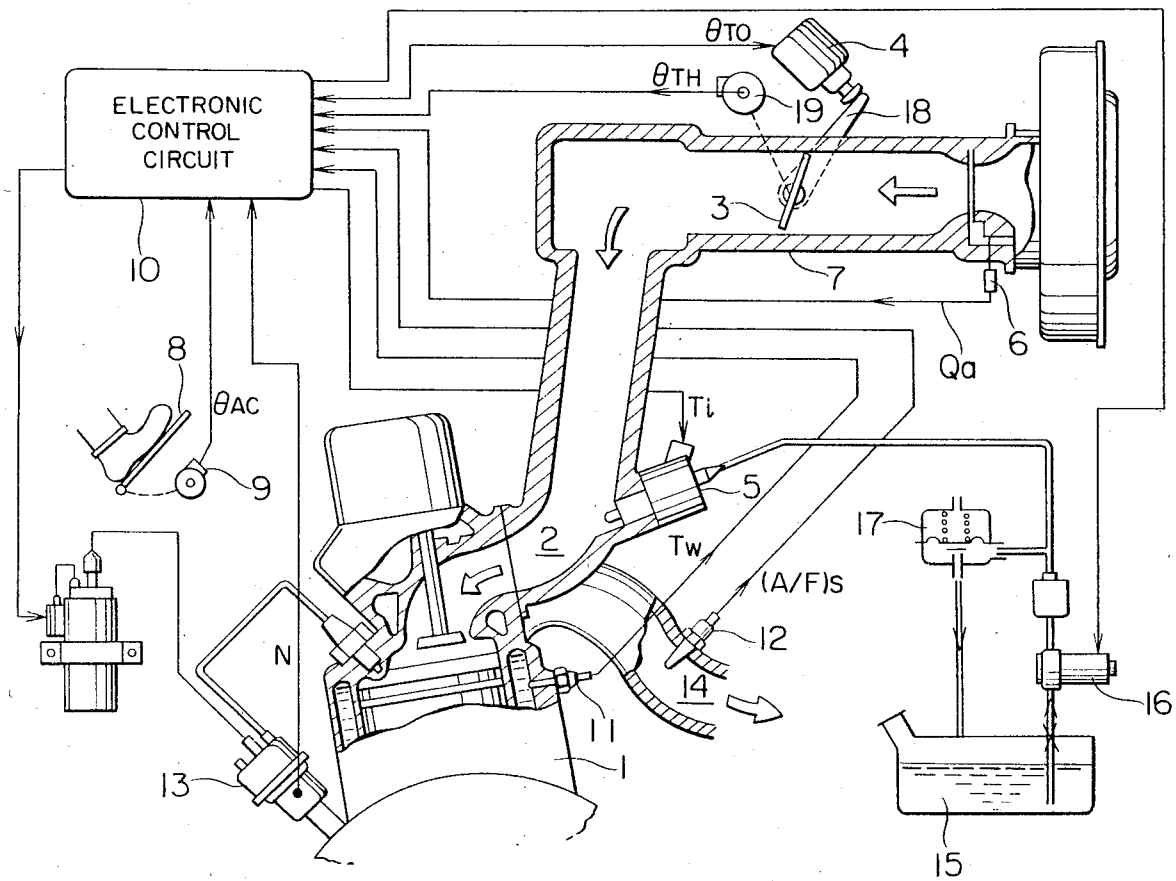
FIG. 1 is a block diagram showing an embodiment of an air-fuel ratio control apparatus for engines according to the invention.

FIG. 1 is a block diagram showing an embodiment of an air-fuel ratio control apparatus according to the invention which is applied to an engine system having a plurality of fuel injection valves. In the Figure, numeral 1 designates an engine, 2 an intake pipe, 3 a throttle valve, 4 a throttle actuator, 5 an injector (fuel injection valve), 6 an intake air-amount sensor, 7 a throttle chamber, 8 an accelerator pedal, 9 an accelerator position sensor, 10 an electronic control circuit, 11 a cooling water temperature sensor, 12 an A/F sensor ($O_2$ sensor), 13 a speed sensor incorporated in a distributor, 14 an exhaust pipe, 15 a fuel tank, 16 a fuel pump, 17 a fuel pressure regulator, and 18 a throttle valve operating lever.

The amount of intake air flow to the engine 1 is controlled by varying the opening of the throttle valve 3 by the throttle actuator 4.

The fuel pumped from the tank 15 and pressurized by the fuel pump 16 is introduced to the injector 5 and the fuel pressure is maintained at a level higher than the intake air by a constant value, by the regulator 17. Then, when the injector 15 is electromagnetically operated by a drive signal Ti, the fuel is injected into the throttle chamber 7 in an amount corresponding to the duration of the applied drive signal Ti.

The actual opening of the throttle valve 3 is detected by the throttle position sensor 19 and it is applied as an opening signal $\theta_{TH}$ to the control circuit 10.

When the accelerator pedal 8 is depressed, its depressed position is detected by the accelerator position sensor 9 and an accelerator position signal $\theta_{AC}$ is applied to the control circuit 10.

When the engine 1 is started, its rotational speed is detected by the speed sensor 13 thus applying a speed signal N to the control circuit 10 and also the cooling water temperature is detected by the temperature sensor 11 thereby applying an engine temperature signal $T_W$ to the control circuit 10.

When the engine 1 is operated so that the exhaust gases flow in the exhaust pipe 14, the A/F sensor 12 detects a signal $(A/F)_S$ indicative of the output A/F.

The control circuit 10 receives the position signal $\theta_{AC}$ indicative of the depressed position of the accelerator pedal 8 from the accelerator position sensor 9 so that in accordance with the signal $\theta_{AC}$, the speed signal N and the temperature signal $T_W$, the desired fuel quantity is computed and a drive signal Ti of the correspond-pulse width is applied to each injector 5 thereby injecting the desired amount of fuel into the throttle chamber 7. Also, in accordance with the computed fuel quantity the desired amount of intake air flow is computed and the corresponding drive signal $\theta_{TO}$ is applied to the throttle actuator 4 thus controlling the opening of the throttle valve 3 at the desired value and controlling the amount of intake air flow at the desired value and thereby performing the desired mixture feed control by the preferential fuel quantity control or follow-up intake air flow control method.

Figure 2:
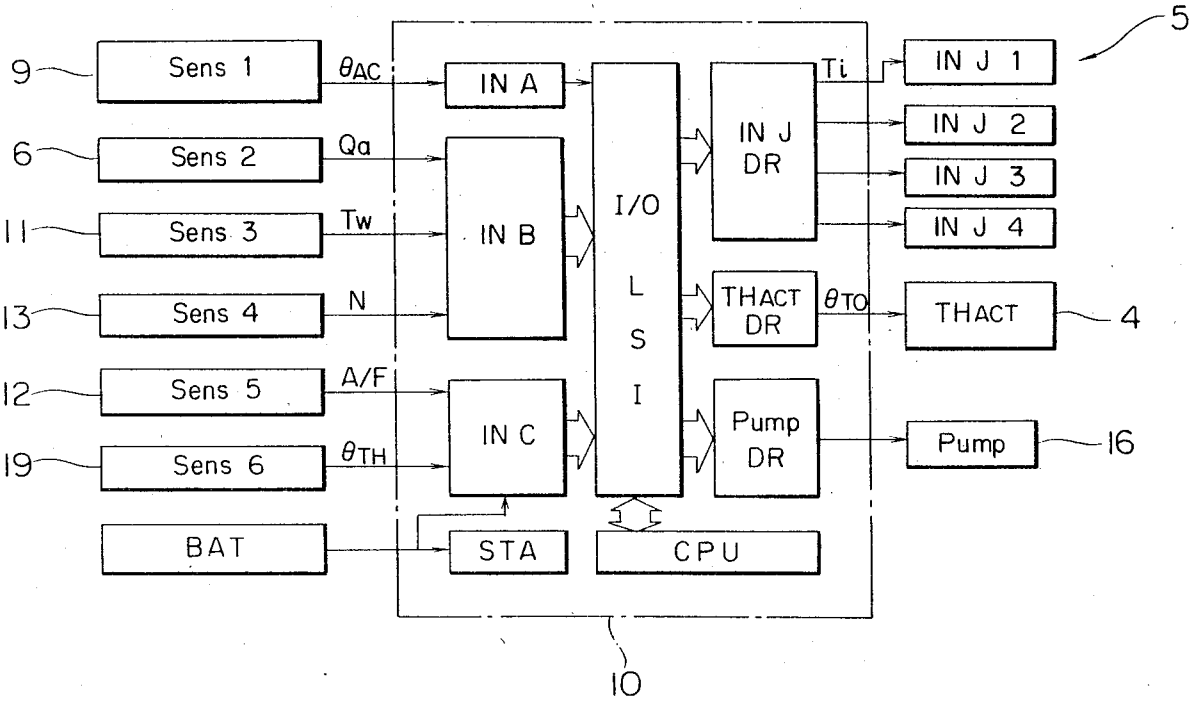
FIG. 2 is a block diagram showing an embodiment of the control circuit in the apparatus of FIG. 1.

FIG. 2 shows an embodiment of the control circuit 10 including a CPU incorporating an ROM and an RAM and forming a microcomputer, an I/0 unit for performing the input and output operations of data, input circuits INA to INC for performing a waveform reshaping function, etc., output circuits DR, etc., thereby receiving the signals $\theta_{TH}$, $\theta_{AC}$, N, $T_W$, $(A/F)_S$, etc., through input ports Sens 1 to 6 and generating the drive signals Ti, $\theta_{TO}$, etc. It is to be noted that the fuel pump 16 is supplied with a signal which goes to a high level only when the engine is started and the engine is in operation, respectively.

Now explaining the throttle actuator 4, the actuator 4 may be any device having good response characteristic and capable of obtaining the required resolution, that is, it may for example be a stepper motor, dc motor, negative pressure servo or linear solenoid.

Figure 3:
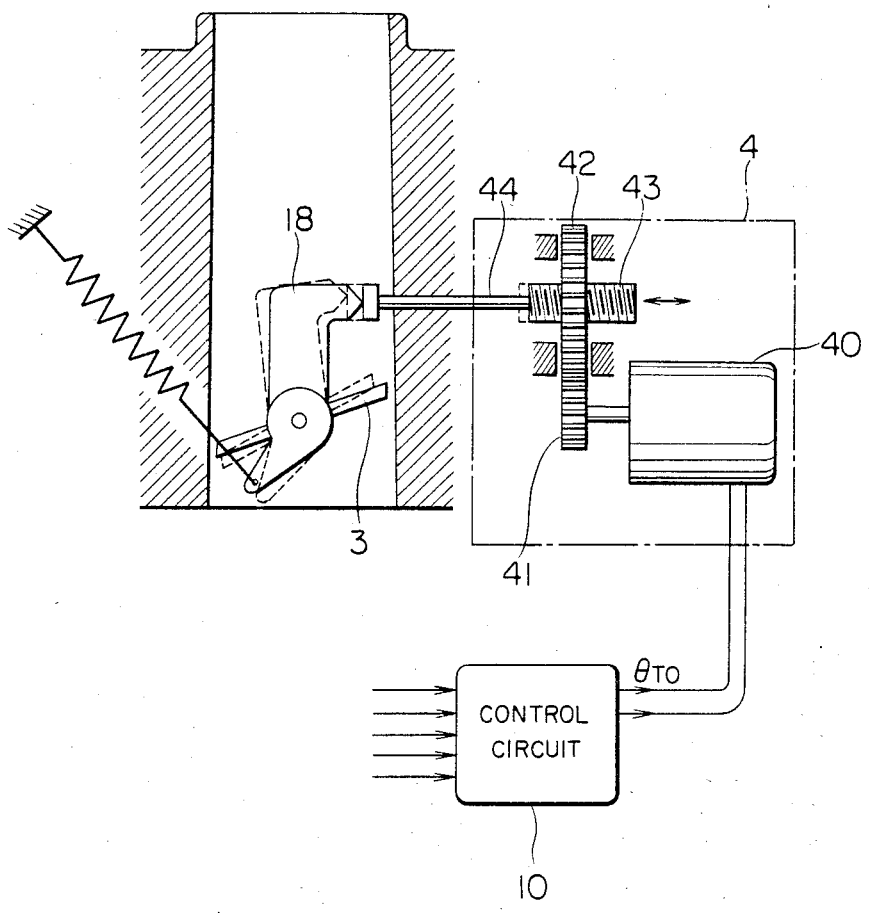
FIG. 3 is a schematic diagram showing an exemplary construction of the throttle actuator in the apparatus of FIG. 1.

FIG. 3 shows an example of the throttle actuator 4 including a dc motor in which the rotation of the dc motor 40 is transmitted at a reduced speed to a gear 42 through a gear 41 and an externally threaded rod 43 meshed with the internally threaded center hole of the gear 42 is moved in the directions of the arrows thus urging the lever 18 of the throttle valve 3 by a push rod 44 and thereby opening and closing the throttle valve 3.

Figure 4:
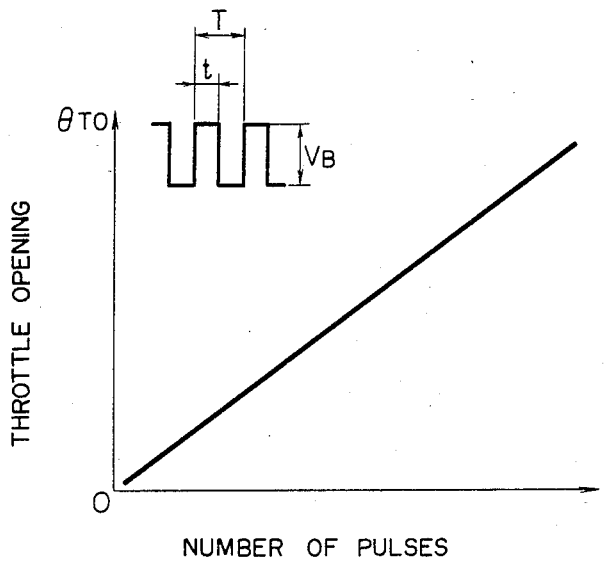
FIG. 4 is a graph showing an example of the control of the throttle actuator in the apparatus of FIG. 1.

Then, while various methods may be conceived to control the dc motor 40, in order to make possible a digital control by the control circuit 10 including a computer, the signal $\theta_{TO}$ is generated as a pulse signal as shown in FIG. 4 and the opening of the throttle valve 3 is controlled in accordance with the number of pulses in the signal.

Figure 5:
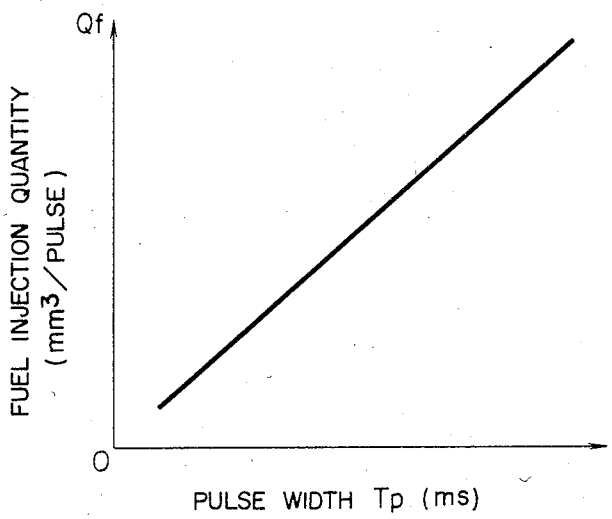
FIG. 5 is a graph showing an example of the characteristic of the injector.

It is to be noted that, as is well known in the art, the injector 5 is generally controlled by a pulse signal and FIG. 5 shows an example of the characteristic of the injector 5. In the Figure, the pulse width $T_P$ represents the pulse width of the drive signal Ti or the duration of opening of the injector 5 and the fuel injection quantity represents the amount of fuel injected per pulse.

Figure 6:
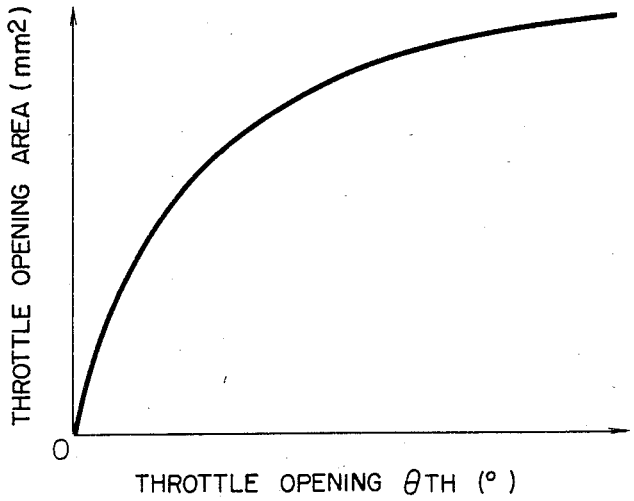
FIG. 6 is a graph showing a valve opening characteristic of the throttle valve.

Referring now to FIG. 6 showing the relation between the throttle angle $\theta_{TH}$ and the actual opening area of the throttle valve 3, it will be seen that there is no linear relation between the throttle opening angle and the throttle valve opening area but the variation of the opening area increases in the small opening angle range and the variation of the opening area decreases with increase in the opening angle. Then, considering the resulting intake air flow to the engine, there results the nonlinear characteristic of FIG. 6 with the engine speed N as a parameter. Thus, where the fuel quantity to be supplied is computed by detecting the throttle opening or the accelerator pedal position signal $\theta_{AC}$, i.e., the driver's command signal, a high degree of resolution is required for the throttle opening angle under such operating conditions where the amount of depression of the accelerator pedal is small and also the engine speed is low and it is necessary to ensure a high degree of resolution for the engine speed under such operating conditions where the engine speed is maintained low despite the increased amount of the accelerator depression.

As a result, if the computations are performed as required under such conditions, it is necessary to process the accelerator pedal position signal and the amount of intake air flow (i.e., the desired fuel quantity) which are correlated very complicatedly and the use of the microcomputer heretofore employed commonly requires a longer processing time with the resulting deterioration of the response characteristic. These are the disadvantages of the known systems employing the preferential fuel control or follow-up intake air flow control method.

Figure 7:
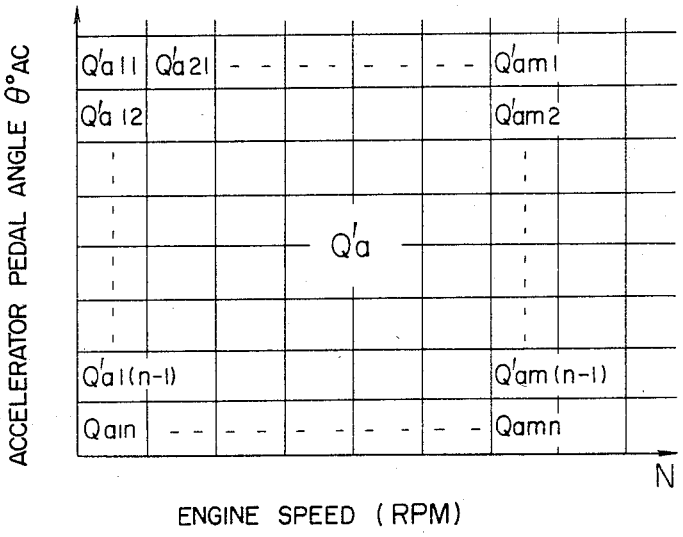
FIG. 7 is a diagram showing an example of the arrangement of an intake air flow memory map.

The present invention overcomes the foregoing deficiencies in the prior art and for this purpose a memory map as shown in FIG. 7 is used and the desired control is performed in accordance with the data preliminarily written in the memory map. This feature will now be described.

Firstly, considering the amount of fuel quantity to be injected per engine revolution (the consideration may be made in terms of the fuel quantity per cycle), it has a proportional relation to the amount of air flow Q'a per engine revolution. On the other hand, if the engine speed N is determined, primarily the desired amount of air flow to the engine is determined by the accelerator pedal angle (position) $\theta_{AC}$ and consequently the desired fuel injection quantity can be obtained so far as the intake air flow Q'a is known.

Thus, in the control circuit 10 the internal memory of the CPU is formed with m×n memory areas (or map areas) for storing data Qa'mn as shown in FIG. 7 and these memory areas are arranged to correspond to m×n engine operating regions which are graphically represented with the ordinate representing the accelerator pedal angle $\theta_{AC}$ and the abscissa representing the engine speed N.

Also, a preset data Q'a corresponding to the values of $\theta_{AC}$ and N is preliminarily obtained by experiments or the like and stored for each of the operating regions. Thus, in the control of the engine the map is searched in accordance with the then current accelerator pedal angle $\theta_{AC}$ and engine speed N so that the data Q'a is read from the corresponding memory area and used to calculate the desired opening duration $T_P$ of the injector 5 from the following equation (1) and thereby control the fuel injection quantity. Then, in accordance with the opening duration $T_P$ and the engine speed N the corresponding signal data $\theta_{TO}$ for driving the throttle actuator 4 is calculated and the throttle actuator 4 is operated by the drive signal $\theta_{TO}$ thereby controlling the amount of intake air flow. In this case, the calculations of the data $T_P$ and $\theta_{TO}$ are made according to the following simple expressions $$T_P=f(Q'a/N),\ \theta_{TO}=f'(T_P N) \quad (1)$$

Figure 8:
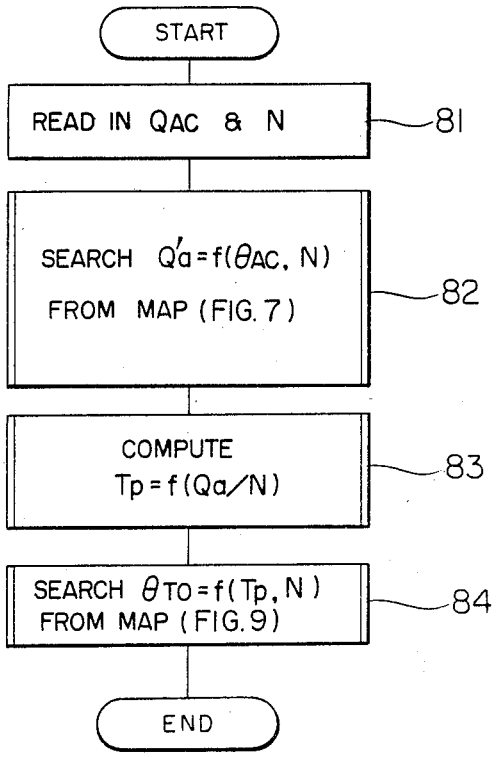
FIG. 8 is a flow chart for explaining the operation of the invention.

Thus, in accordance with the present embodiment, the control of the throttle valve can be effected by simply reading two data, i.e., the accelerator pedal angle $\theta_{AC}$ and the engine speed N, obtaining the corresponding air flow Q'a by map searching and performing the simple calculation of obtaining the opening duration $T_P$ as shown in FIG. 8. More specifically, at a step 81, the data $\theta_{AC}$ and N from the sensors 9 and 13 are read at intervals of 10 m sec, for example, in the execution of the flow-chart in FIG. 8. Then, the corresponding air flow Q'a is obtained by map searching from the map shown in FIG. 7 at a step 82 and then the desired injector opening duration $T_P$ is calculated in accordance with the air flow Q'a and the engine speed N at a step 83 Then at a step 84 the desired drive signal data $\theta_{TO}$ is obtained from the map of FIG. 9 in accordance with the data $T_P$ and the engine speed N. Thus, there is no need to perform such calculations which take into consideration the nonlinear characteristic such as shown in FIG. 6 and an excellent response characteristic and greater control accuracy are ensured.

While, in the above-described embodiment, the data Q'a indicative of the amounts of intake air flow are written in the memory as will be seen from FIG. 7, the data $T_P$ may be directly written in the memory in place of the data Q'a.

This modification of the embodiment makes it possible to directly obtain the data $T_P$ by map searching with the result that the computing step of the data $T_P$ in FIG. 8 is eliminated and the processing is made simpler and faster.

Figure 9:
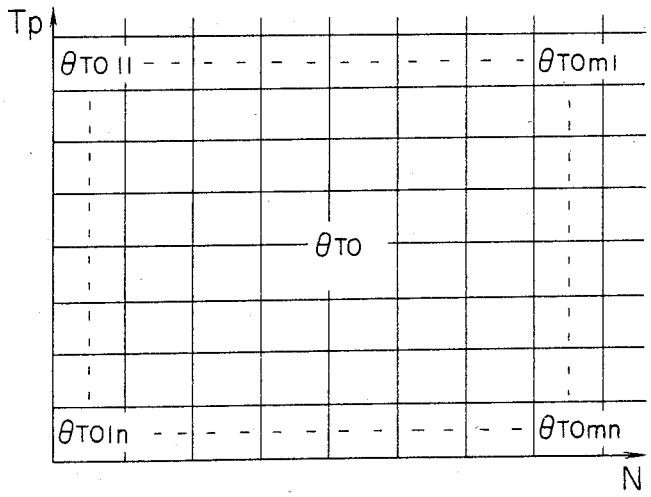
FIG. 9 is a diagram showing an example of the arrangement of a throttle drive signal $\theta_{T0}$ memory map.

Referring now to FIG. 9, as described hereinabove, the m×n different memory areas are arranged to correspond to the data $T_P$ and N and the corresponding data $\theta_{TO}$ is written in each of the memory areas thereby obtaining the desired data $\theta_{TO}$ by searching the map as shown at the step 84.

Figure 10:
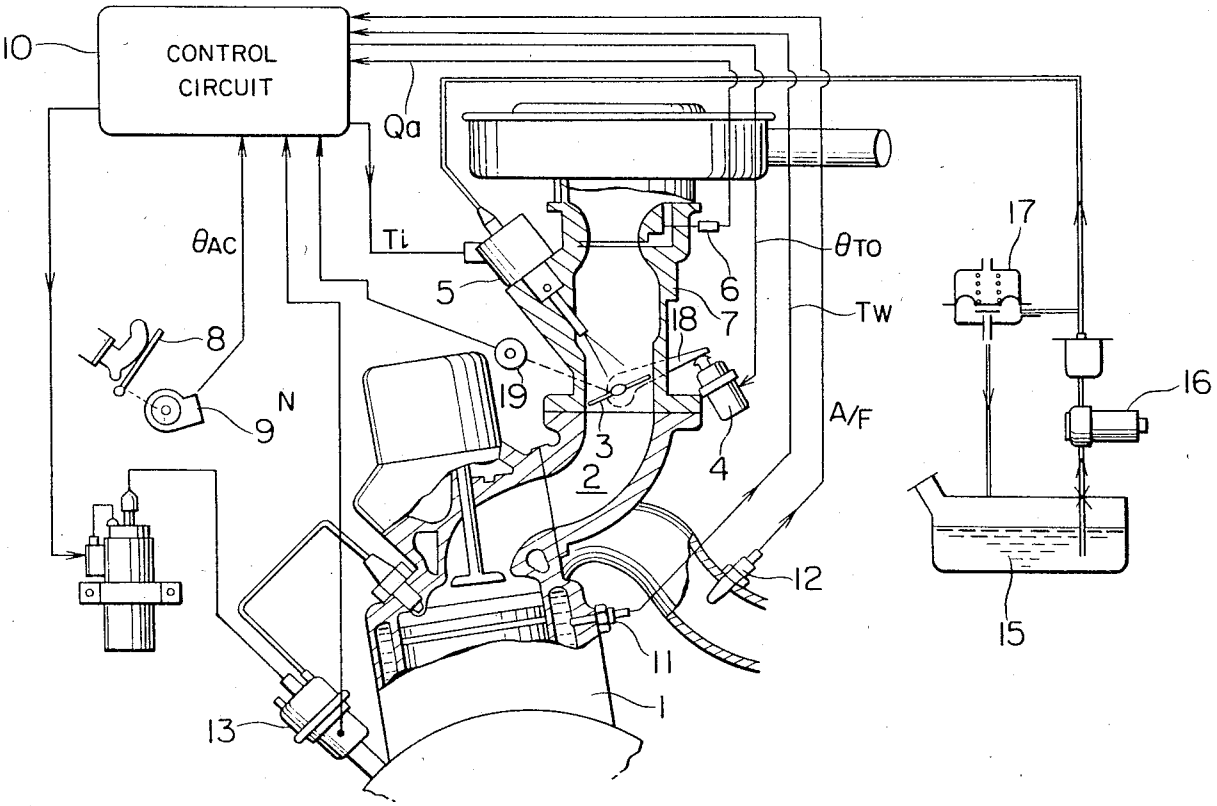
FIG. 10 is a block diagram showing a second embodiment of the air-fuel ratio control apparatus for engines according to the invention.
Figure 11:
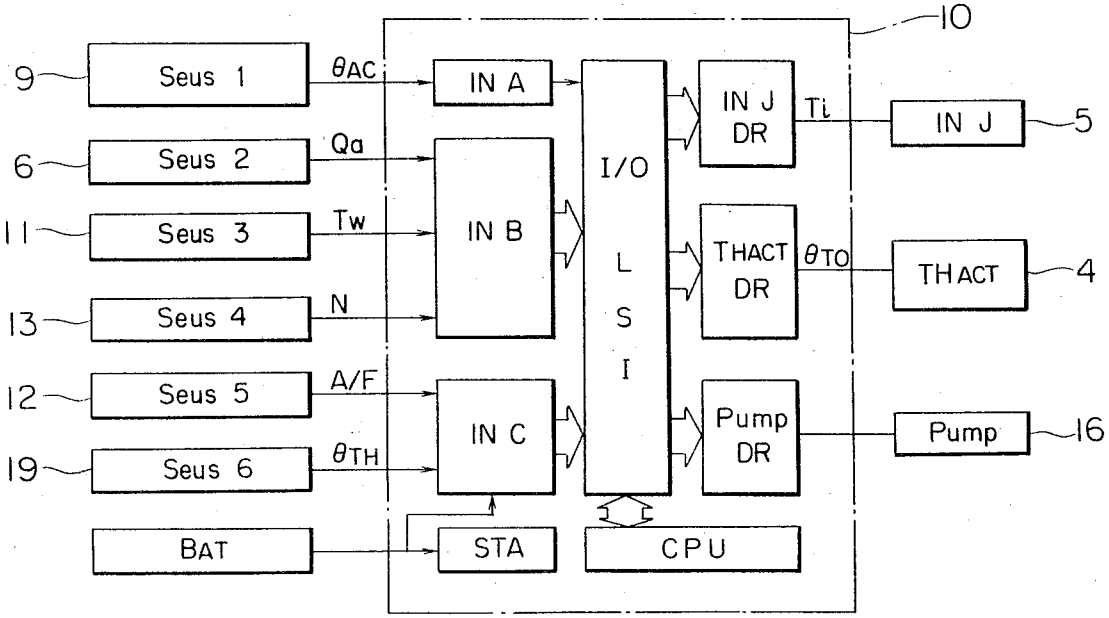
FIG. 11 is a block diagram showing an embodiment of the control circuit in the control apparatus of FIG. 10.

FIG. 10 shows another engine system which differs from the engine control system of FIG. 1 only in that a single fuel injection valve is used in place of a plurality of injection valves. Thus, the same or equivalent components as used in FIG. 1 are designated by the same numerals as used in FIG. 10. These components are operated in the like manner as in FIG. 1 and will not be described. FIG. 11 corresponds to FIG. 2 and only a single injector 5 is included.

Figure 12:
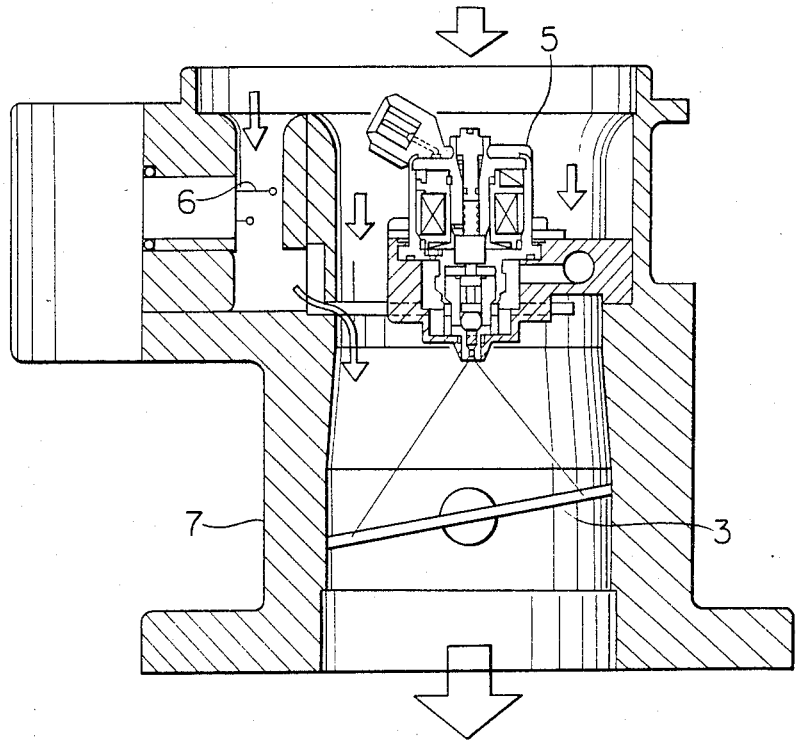
FIG. 12 is a schematic sectional view showing the fuel injection valve used in the apparatus of FIG. 10 and its arrangement.

FIG. 12 is a sectional view showing an exemplary construction of the single injector 5 arranged upstream of the throttle valve 3. The use of this upstream injection-type injector 5 is advantageous in that the injection pressure of fuel is set so low that the cost of the fuel pressurizing mechanism (the pump 16 and the regulator 17) is reduced and also the sprayed fuel is further atomized by the throttle valve 3.

Figure 13:
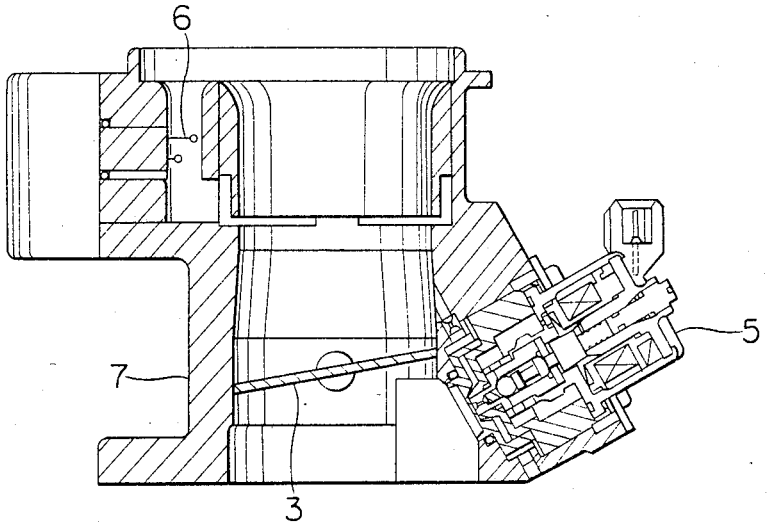
FIG. 13 is a schematic sectional view showing another embodiment of the fuel injection valve used in the apparatus of FIG. 10 and its arrangement.

FIG. 13 is a sectional view showing another exemplary construction of the injector 5 which is arranged downstream of the throttle valve 3. When the injector 5 of this downstream injection type is used, there is the advantage of stabilizing the performance of the engine on the whole, although there is a disadvantage that it is difficult to align the axial center of the injector 5 with the center of the throttle chamber 7 and the engine performance is affected by the sprayed fuel. The advantage of the present invention results from the fact that there is no influence due to delay of the fuel control based on the adhesion of fuel to the throttle valve 3.

Figure 14:
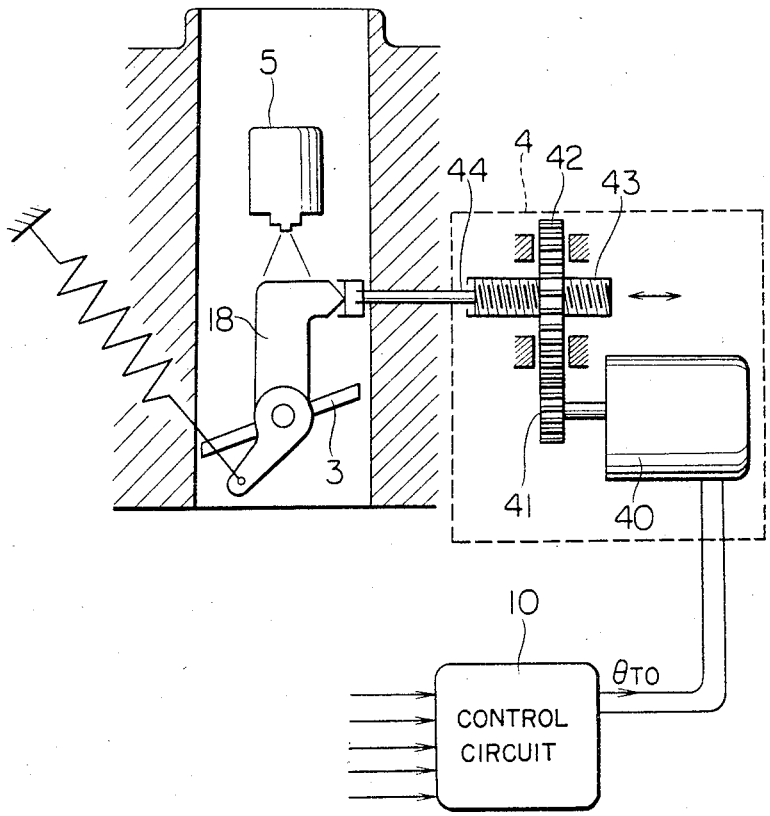
FIG. 14 is a schematic diagram showing an example of the control of the throttle actuator in the apparatus shown in FIG. 10.

FIG. 14 is a diagram corresponding to FIG. 3 and it shows the positional relation of the throttle valve 3 and the injector 5.

Then, the injector 5 used in the embodiment of FIG. 10 has a characteristic such that the fuel injection quantity per injection is increased substantially in proportion to the pulse width of the valve opening signal $T_P$ as shown by the characteristic diagram of FIG. 5. Also, the throttle actuator 4 has a characteristic such that the opening of the throttle valve 3 is increased substantially in proportion to the number of pulses of a pulse width t within a time interval T as shown by the characteristic diagram of FIG. 4. The use of the components of these characteristics has the advantage of making it possible to easily effect the control digitally.

Figure 15:
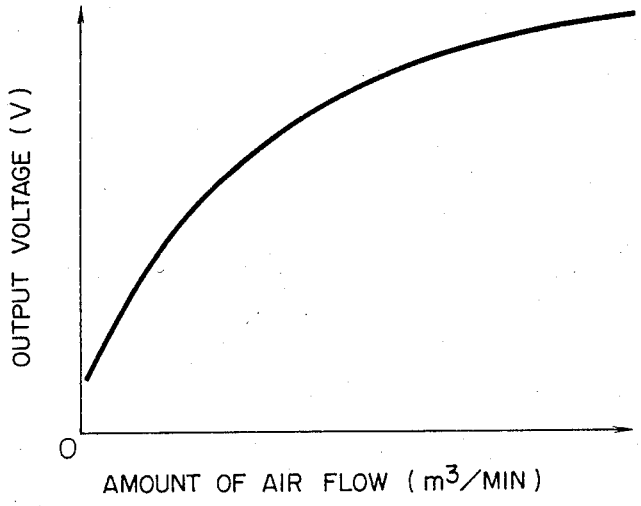
FIG. 15 is a graph showing an output characteristic of the air flow meter in the apparatus shown in FIG. 10.

Also, the air flow sensor 6 is of the type having the characteristic shown by the characteristic diagram of FIG. 15.

With the construction described above, the control operation of the throttle valve opening and the fuel injection time will now be described with reference to FIGS. 16, 17 and 18.

Figure 16:
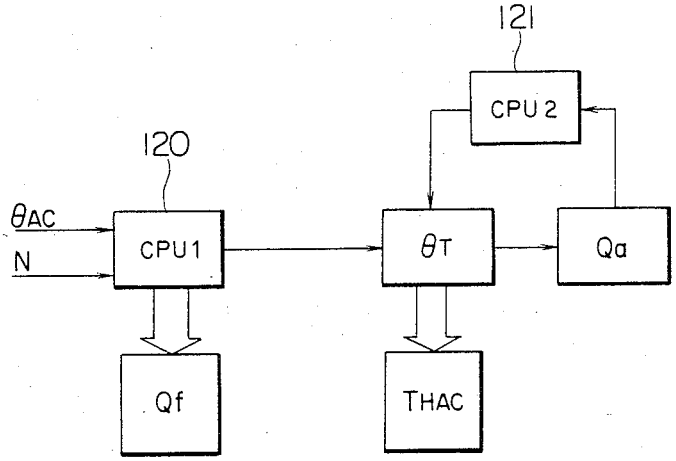
FIG. 16 is a block diagram for functionally explaining the control procedure of the apparatus shown in FIG. 10.
Figure 17:
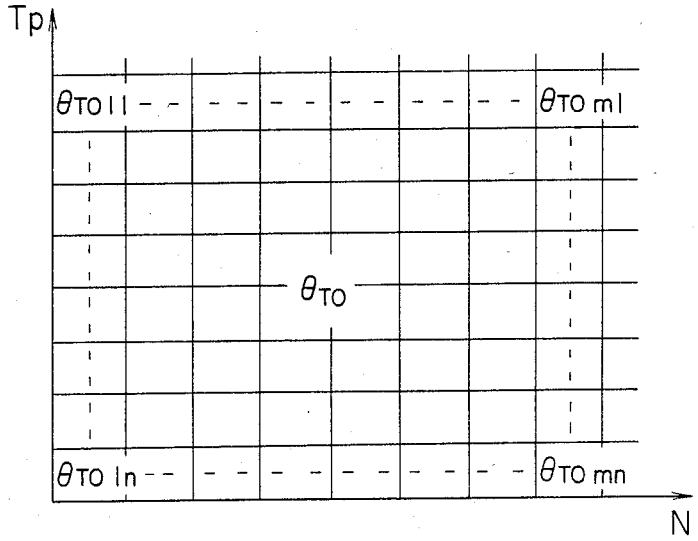
FIG. 17 is a diagram showing the arrangement of a map from which throttle actuator drive signals are read.

FIG. 16 is a functional block diagram showing the contents of the control operation in the form of functional blocks, in which an accelerator position detection signal $\theta_{AC}$ and an engine speed detection signal N are applied to a first control unit 120 so that the optimum fuel injection quantity $Q_f$ to the operating conditions corresponding to the signals $\theta_{AC}$ and N is determined and the corresponding amount of intake air flow $Q_a$ to the fuel injection quantity $Q_f$ is determined so as to obtain the optimum air-fuel ratio. Then, the result is applied to a second control unit 121 so that the throttle valve opening $\theta_{AC}$ corresponding to the computed intake air flow $Q_a$ is determined and a drive signal $\theta_{TO}$ to be applied to the throttle actuator 4 is generated so as to attain the opening $\theta_{AC}$. In this case, the actual amount of intake air flow Q is detected from the output signal of the air flow sensor 6 so that if there is any error between the desired value and the actual value, the pulse width of the drive signal $\theta_{TO}$ applied to the throttle actuator 4 is corrected so as to reduce the error to zero.

By virtue of this control, the amount of intake air flow amount $Q_a$ follows and corresponds to the fuel injection quantity $Q_f$.

Figure 18:
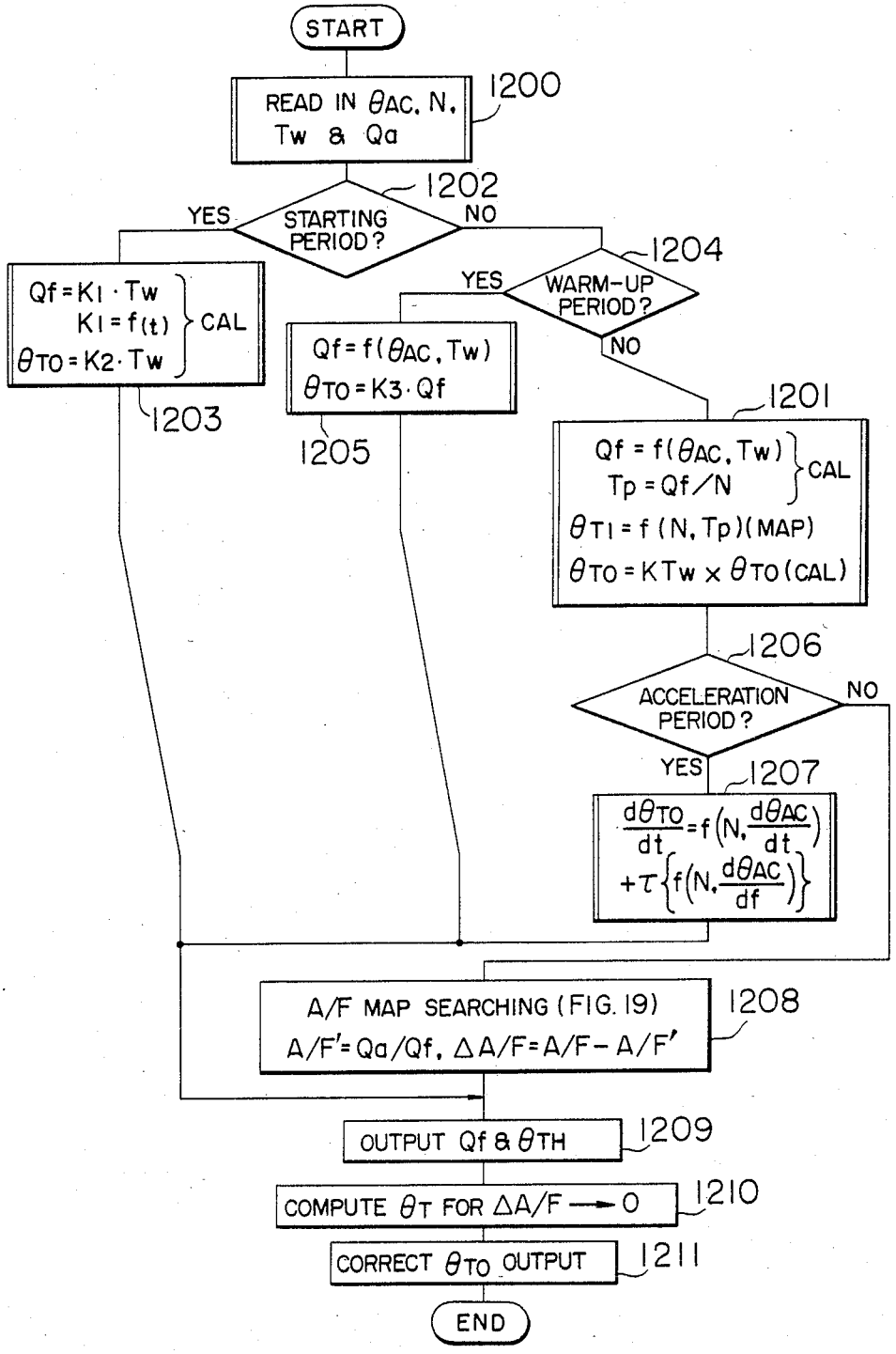
FIG. 18 is a flow chart showing the control method of the apparatus shown in FIG. 10.

FIG. 18 is a flow chart showing the control contents in greater detail and the operations corresponding to the flow chart are controlled by the CPU of the control circuit 10. The program shown by the flow chart is started each constant interval of time. When the execution of the program is started, the sensor output signals indicative of the throttle valve opening $\theta_{AC}$, engine temperature $T_W$, engine speed N, etc., are read in to detect the operating conditions of the engine (step 1200).

Then, a decision is made as to whether it is the time that the starter motor is being operated to start the engine (step 1202) so that if it is, the fuel injection quantity $Q_f$ is computed using only the engine temperature $T_W$ as a variable and the pulse width of the drive signal $\theta_{TO}$ to the throttle actuator 4 is also computed using only the engine temperature $T_W$ as a variable (step 1203). In other words, during the starting period the throttle valve opening is determined only in dependence on the engine temperature $T_W$ irrespective of the fuel injection quantity $Q_f$.

On the other hand, during the warm-up period after the starting, the fuel injection quantity $Q_f$ is determined in accordance with the engine temperature $T_W$ and the actual throttle valve opening $\theta_{AC}$ and the pulse width of the drive signal $\theta_{TO}$ to the throttle actuator 4 is set to a value proportional to the fuel injection quantity $Q_f$ (step 1205).

In a normal condition, i.e. during a no-warming-up period, the process is advanced to a step 1201 to calculate the supply amount of fuel $Q_f$ and the throttle valve opening $\theta_{TO}$.

Namely, in accordance with the operating conditions the fuel injection quantity $Q_f$ and the pulse width of the drive signal $\theta_{TO}$ to the throttle actuator 4 are obtained in accordance with the following equations (step 1201).

$$Q_f = f(\theta_A, T_W) \text{ (calculation)} \quad (2)$$

$$T_P = Q_f/N \text{ (calculation)} \quad (3)$$

$$\theta_{T1} = f(N, T_P) \text{ (map searching)} \quad (4)$$

$$\theta_{T0} = KT_W \times \theta_{T1} \quad (5)$$

On the other hand, if the calculation of a differentiated value $d\theta_{AC}/dt$ of the throttle valve opening $\theta_{AC}$ detects that the engine is being accelerated, a predetermined time delay value $\tau$ is added to the differentiated value $d\theta_{AC}/dt$ (step 1207) and the drive signal $\theta_{TO}$ to the throttle actuator 4 which was previously determined at the step 1201 is delivered.

In other words, the control is effected such that if the value of $f(N, d\theta_{AC}/dt)$ is increased during the acceleration operation as shown by the following $$\frac{d\theta_{TO}}{dt} = f\left(N, \frac{d\theta_{AC}}{dt}\right) + \tau \quad (6)$$

the time delay $\tau$ is added and the time rate of change of the throttle valve 3 is decreased thereby enriching the A/F ratio during the initial period of the acceleration operation. In other words, the control is performed so that even if the accelerator pedal is depressed rapidly, the rate of change of the drive signal $\theta_{TO}$ is reduced and the fuel is enriched.

When the acceleration is detected by the step 1206, the execution number of the step 1207 is counted. Assuming that the counted value is NP, the modification of the value $\theta_{TO}$ is stopped until the value NP reaches the value $\tau$ operated in the step 1207. By this the control delay of the throttle valve 3 can be decided. When NP $\geqq \tau$, the value $\theta_{TO}$ is modified at each execution of the step 1207 by the value $f(N, d\theta_{AC}/dt)$. The execution of the step 1207 is effected at a constant interval of time. If the flow-chart of FIG. 18 is executed each 10 m second, for example, the execution of the step 1207 is also effected each 10 m sec. Therefore if the target value is modified by a single execution by the value of $f(N, d\theta_{AC}/dt)$, the throttle valve 3 is consequently changed by the value of $d\theta_{TO}/dt$.

In the above explanation, the $\theta_{TO}$ is changed after the lapse of time corresponding to the value $\tau$, however alternatively it may be possible to gradually increase the changing value of the $\theta_{TO}$ together with the count value NP, thereby to change it by the value of $f(N, d\theta_{AC}/dt)$ each one execution after the lapse of time corresponding to the value $\tau$.

On the other hand, in a no acceleration state, it is controlled by the values $Q_f$ and $\theta_{TO}$ calculated in the step 1201.

Figure 19:
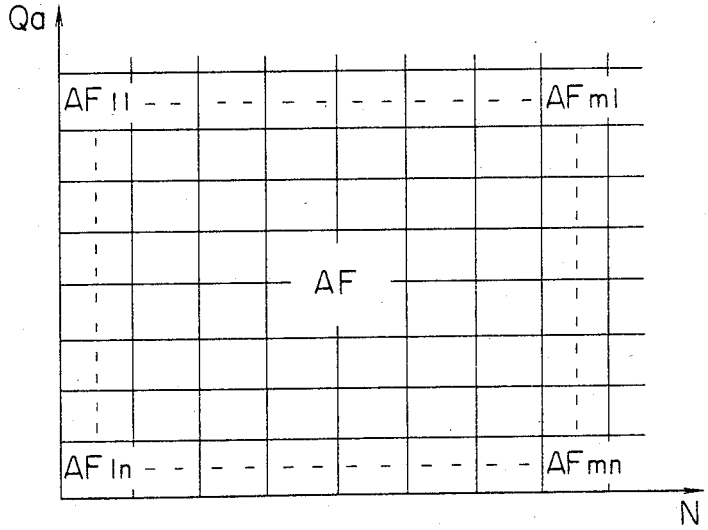
FIG. 19 is a diagram showing the arrangement of the map in the apparatus of FIG. 10 from which air-fuel ratios are read.

On the contrary, if the engine is in the steady-state operation and not in the acceleration operation, the ideal A/F is read from a map of the actual amounts of intake air flow $Q_a$ and the engine speeds N as shown in FIG. 19 and it is compared with the A/F due to the amount of intake air flow that would be supplied by the pulse width of the drive signal $\theta_{TO}$ previously obtained from the map at the step 1201 to compute any difference between the two. If there is the difference, the pulse width of the drive signal $\theta_{TO}$ is corrected so as to reduce the difference to zero (steps 1208 and 1210).

The thus computed fuel injection quantity $Q_f$ is then delivered as a valve opening signal $T_P$ to be applied to the injector 5. Then, the drive signal $\theta_{TO}$ is also applied to the throttle actuator 4. As a result, the fuel injection quantity and the throttle valve opening are optimized to suit the engine operating conditions. Since this control is performed by the preferential fuel control method, there is the effect of considerably improving the drivability during the transitional period of the engine operating conditions such as the acceleration operation.

In accordance with the above-described embodiments, due to the considerably simplified computation of the necessary data for controlling purposes, the engine control is performed in such a manner that a satisfactory control response characteristic is ensured, that the high-accuracy A/F control is always effected under various engine operating conditions including the transitional conditions, that the deterioration of exhaust gas emission is reduced and that the driving characteristic is improved.

Further, since any desired control characteristic is obtained by simply adjusting the data stored in a memory, it is possible to provide an engine control apparatus which is capable of easily changing its characteristics and having a wide range of applications.

I claim:

1. In an electronic air-fuel ratio control apparatus for an internal combustion engine including a throttle actuator for varying the opening of a throttle valve arranged in an intake passage of said engine and at least one fuel injection valve positioned upstream or downstream of said throttle value to inject fuel, thereby controlling the air-fuel ratio of a mixture supplied to the combustion chambers of said engine, the improvement comprising:

first sensor means for detecting the rotational speed of said engine and for producing an output signal representative of said rotational speed;

second sensor means for detecting an operation command quantity by a driver and for producing an output signal representative of said quantity, including means for detecting an acceleration command by the driver;

first computing means responsive to output signals from said first and second sensors for computing at periodic intervals a quantity of fuel to be injected from said fuel injection value; and second computing means responsive to said fuel injection quantity computed by said first computing means at each of said periodic intervals for computing an optimum throttle opening for the computed quantity of fuel to be injected and for driving said throttle actuator to attain said optimum throttle opening independent of the quantity of the driver operation command, including means responsive to detection of said acceleration command by said second sensor means for driving said throttle actuator with a predetermined delay to provide fuel enrichment during acceleration.

2. An apparatus according to claim 1, wherein the computation of said first computing means is effected by using an amount of intake air flow read from a first memory in accordance with the output signals from said first and second sensor means, and wherein the computation of said second computing means is effected by reading said throttle actuator drive signal from a second memory in accordance with the output signal from said first sensor means and said computed fuel injection quantity.

3. An apparatus according to claim 1, wherein said fuel injection valve is provided for each of a plurality of cylinders of said engine, and wherein said fuel injection valves are positioned downstream of said throttle valve.

4. An apparatus according to claim 1, wherein only one said fuel injection valve is provided for a plurality of cylinders of said engine, and wherein said fuel injection valve is positioned upstream of said throttle valve.

* * * * *